US005634810A

United States Patent [19]

Niitsu et al.

[11] Patent Number: 5,634,810

[45] Date of Patent: Jun. 3, 1997

[54] PRINTED CIRCUIT BOARD MOUNTED ELECTRICAL CONNECTOR ASSEMBLY

[75] Inventors: Toshihiro Niitsu, Yokohama; Masashi Seto, Zama, both of Japan

[73] Assignee: Molex Incorporated, Lisle, Ill.

[21] Appl. No.: 408,246

[22] Filed: Mar. 22, 1995

[51] Int. Cl.[6] ..... H01R 23/72

[52] U.S. Cl. ..... 439/378; 439/554; 439/567

[58] Field of Search ..... 439/78, 378, 567, 439/571, 572, 552, 554, 557

[56] References Cited

U.S. PATENT DOCUMENTS

| | | | |
|---|---|---|---|
| 3,394,337 | 7/1968 | Miller | 439/680 |
| 4,173,387 | 11/1979 | Zell | 439/557 |
| 4,363,530 | 12/1982 | Verhoeven | 439/78 |
| 5,080,611 | 1/1992 | Hypes | 439/554 |
| 5,340,319 | 8/1994 | Enomoto et al. | 439/75 |
| 5,356,300 | 10/1994 | Costello et al. | 439/101 |
| 5,478,253 | 12/1995 | Biechler et al. | 439/567 |

FOREIGN PATENT DOCUMENTS

| | | | |
|---|---|---|---|
| 6-52944 | 2/1994 | Japan | H01R 23/68 |

*Primary Examiner*—Steven C. Bishop

*Attorney, Agent, or Firm*—Stephen Z. Weiss

[57] ABSTRACT

An electrical connector assembly is provided for releasably connecting a first connector to a printed circuit board. The assembly includes a first connector including an elongated dielectric housing having a generally rigid locating post disposed at each opposite end of the housing and adapted to pass through the circuit board. A second connector is adapted for mounting to the opposite side of the circuit board and includes an elongated dielectric housing having an outwardly opening semi-cylindrical locating channel at each opposite end of the elongated housing of the second connector for receiving the locating posts and establishing a non-conductive interference fit therewith. A pair of boardlocks are disposed generally on opposite lateral sides of each of the locating channels and are adapted for insertion into appropriate boardlock holes in the circuit board. Terminals are mounted on the housing of the first connector and are adapted to extend into appropriate terminal-receiving holes in the printed circuit board.

8 Claims, 5 Drawing Sheets

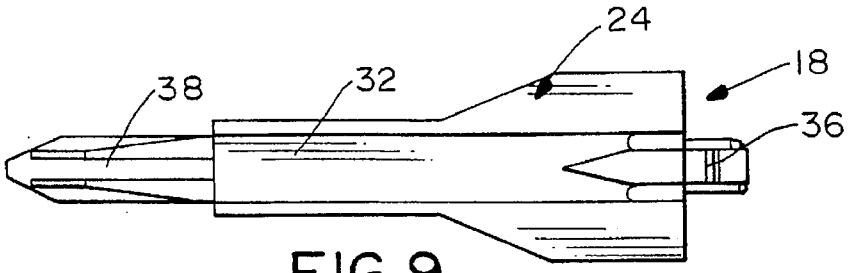
FIG. 9
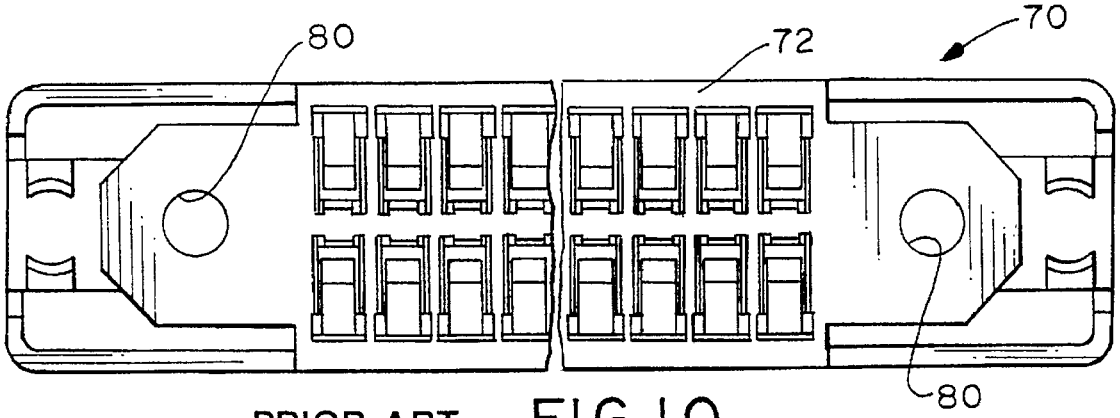
PRIOR ART FIG. 10
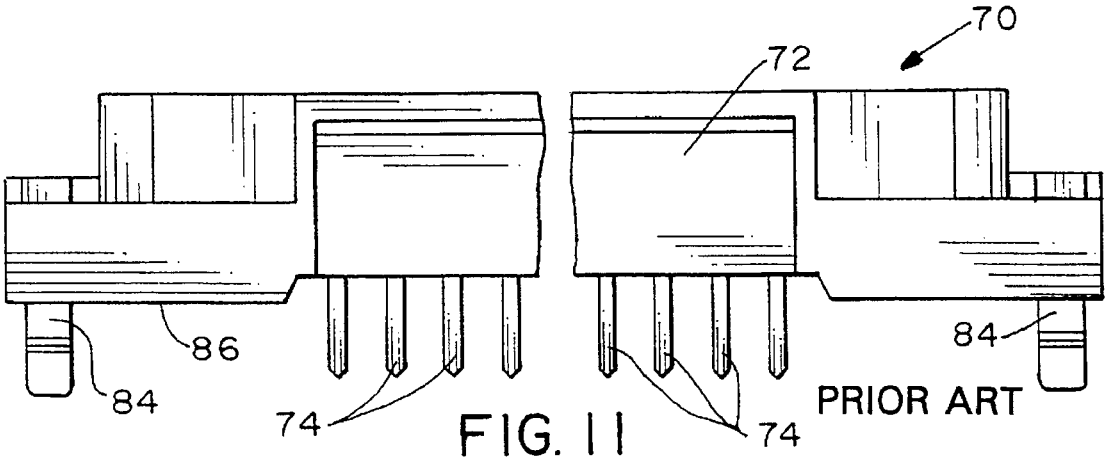
FIG. 11 PRIOR ART
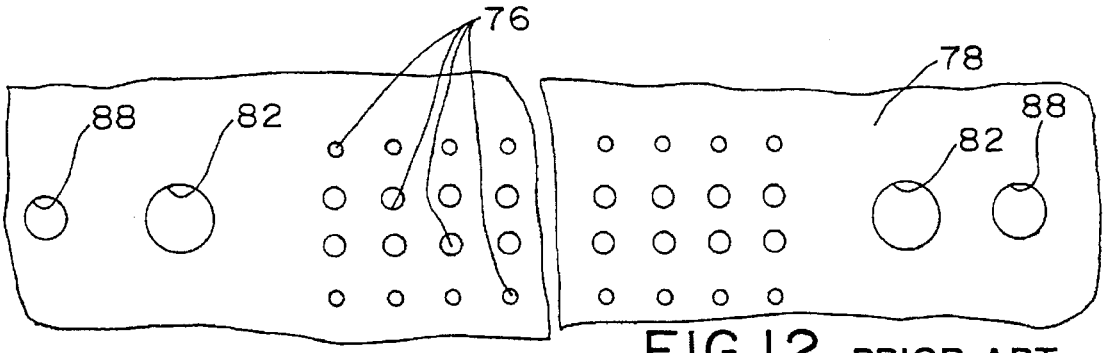
FIG. 12 PRIOR ART

PRINTED CIRCUIT BOARD MOUNTED ELECTRICAL CONNECTOR ASSEMBLY

FIELD OF THE INVENTION

This invention generally relates to the art of electrical connectors and, particularly, to an electrical connector assembly which includes a pair of interengageable electrical connectors mounted on opposite sides of a printed circuit board.

BACKGROUND OF THE INVENTION

It is known to provide an electrical connector assembly releasably connecting a connector to a printed circuit board. The assembly includes a first and second connector where the first connector has terminal means extending through terminal receiving holes in the circuit board and the connectors sandwiching the board therebetween. The connectors are held together by means of locating posts projecting from one of the connectors, and either creating an interference fit in a circuit board aperture or passing through the circuit board aperture and creating an interference fit in locating holes in the other connector. Typically, the other connector has a plurality of boardlocks projecting into holes in the printed circuit board.

More particularly, prior art connector assemblies of the character described above usually include elongated housings having terminal means mounted therein. The locating posts and the locating holes are disposed at opposite ends of the housings. The boardlocks then are disposed longitudinally outside the locating posts and holes. Providing all of these locating and mounting components at the opposite ends of the connector, longitudinally beyond the terminal means in the connector housing, greatly increases the lengths of the connectors. This causes problems in requiring excessively large and expensive connector housings. The unduly large connectors also take up valuable space or "real estate" on the printed circuit board. The present invention is directed to solving these problems by providing an improved arrangement of locating means and boardlock means on the pair of interengageable electrical connectors.

SUMMARY OF THE INVENTION

An object, therefore, of the invention is to provide a new and improved electrical connector assembly of the character described for releasably connecting to a printed circuit board.

In the exemplary embodiment of the invention, the connector assembly includes a pair of electrical connectors coupled together with one connector having means extending through terminal receiving holes in the printed circuit board and sandwiching the circuit board therebetween. In particular, a first connector includes an elongated dielectric housing having a generally rigid locating post disposed at each opposite end of the housing and adapted to pass through the circuit board.

A second connector is adapted for mounting to the opposite side of the printed circuit board. The second connector includes an elongated dielectric housing having an outwardly opening semi-cylindrical locating channel at each opposite end of the elongated housing of the second connector for receiving the locating posts and establishing a non-conductive interference fit therewith. A pair of boardlocks are disposed generally on opposite lateral sides of each of the locating channels and are adapted for insertion into appropriate boardlock holes in the circuit board.

Specifically, the first connector includes terminal means extending through the printed circuit board and electrically connected to terminal means on the second connector. The second connector includes additional terminal means outside the terminal means and adapted for electrical connection to circuit means on the printed circuit board. As disclosed herein, the housing of the second connector is narrower than the housing of the first connector, and the additional terminal means on the second connector are arranged in at least one row lengthwise of the connectors outside the terminal means of the first connector.

Still further, one of the connectors is a spacer connector including a first face for mating to the second connector through the printed circuit board and a second mounting face for mounting to a second printed circuit board. The other connector includes a mounting face for mounting to the printed circuit board and an opposing mating face for receiving the terminals of a complementary mating connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 9 is an end elevational view of the connector shown in FIGS. 7 and 8;

FIG. 10 is a fragmented plan view of the boardmounting face of a connector according to the prior art;

FIG. 11 is a fragmented side elevational view of the prior art connector shown in FIG. 10; and FIG. 12 is a fragmented plan view of the pattern of holes in the printed circuit board to which the prior art connector of FIGS. 10 and 11 is mounted.

DETAILED DESCRIPTION OF THE PREFERRED EMBODIMENT

Figure 1:
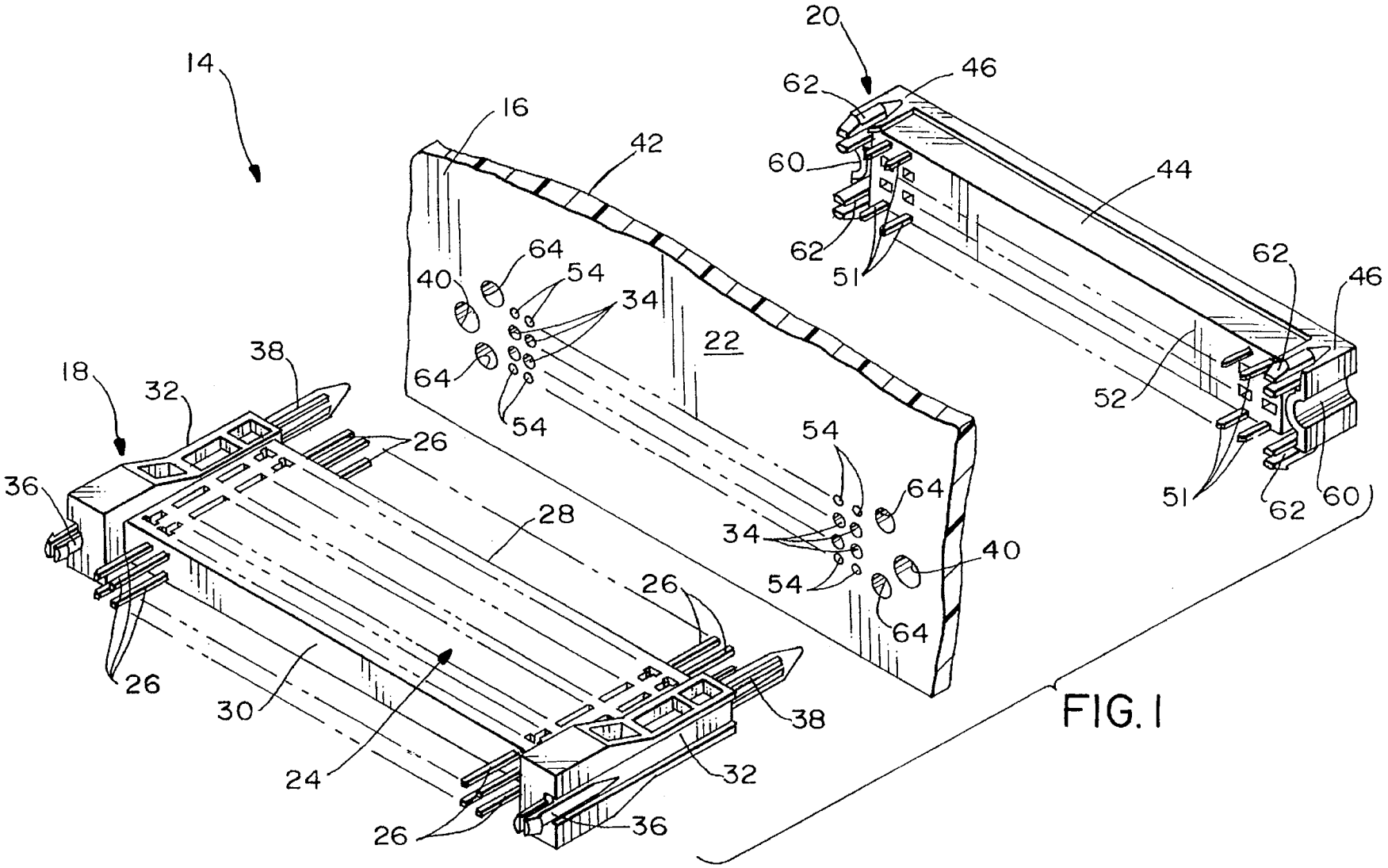
FIG. 1 is a perspective view of the electrical connector assembly with the pair of electrical connectors shown spaced on opposite sides of a printed circuit board.
Figure 2:
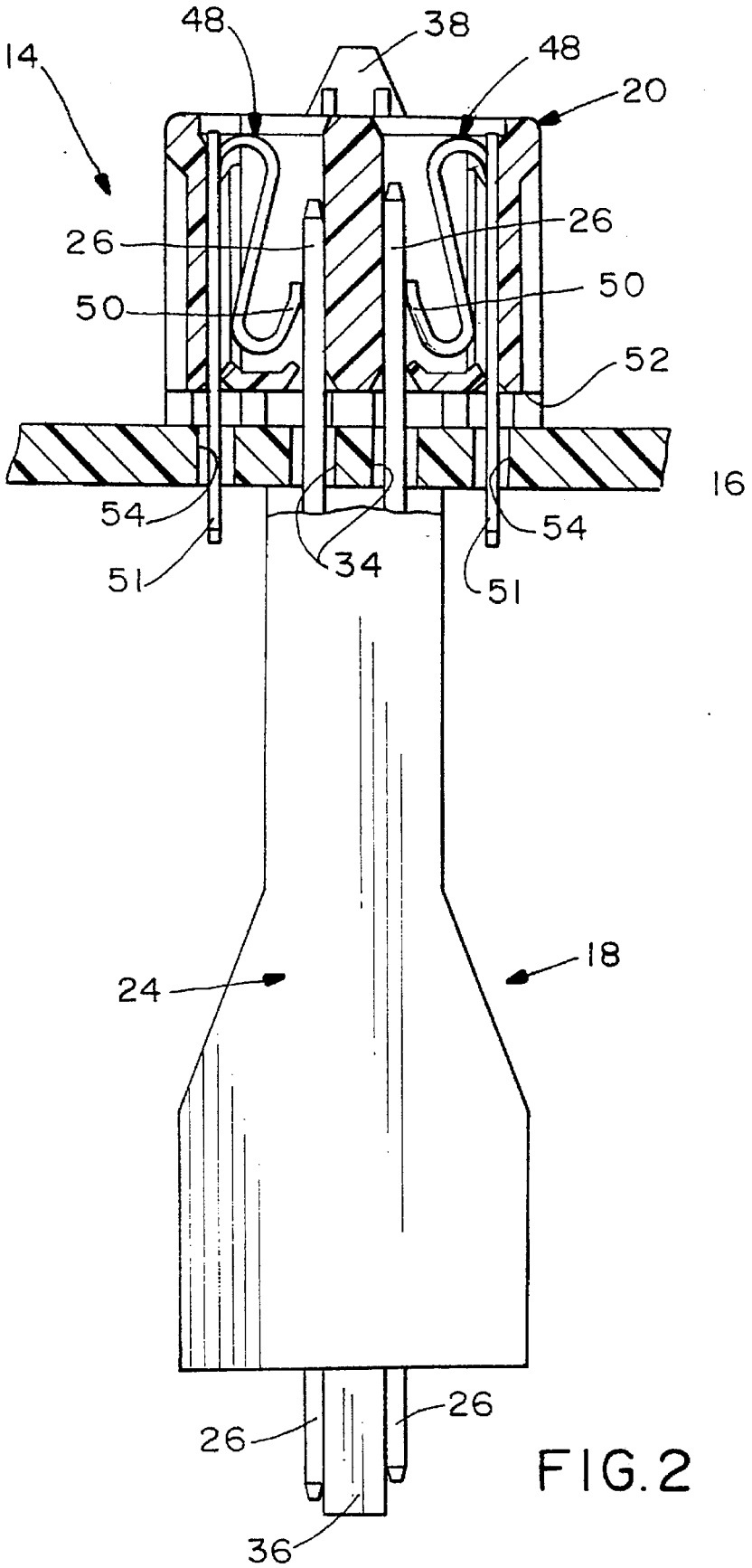
FIG. 2 is an end elevational view of the connectors coupled together through the printed circuit board and sandwiching the board therebetween, with the board and one of the connectors in section.

Referring to the drawings in greater detail, and first to FIGS. 1 and 2, the invention is embodied in an electrical connector assembly, generally designated 14, for connectors located on opposite sides of a printed circuit board 16. Generally, the connector assembly includes a first electrical connector, generally designated 18, and a second electrical connector, generally designated 20, which are adapted to be coupled together through circuit board 16 and sandwiching the board therebetween as seen in FIG. 2.

Figure 7:
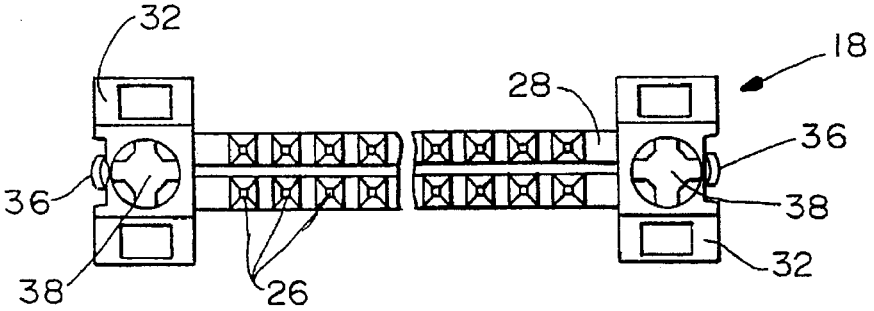
FIG. 7 is a fragmented top plan view of the bottom connector shown in FIG. 2.
Figure 8:
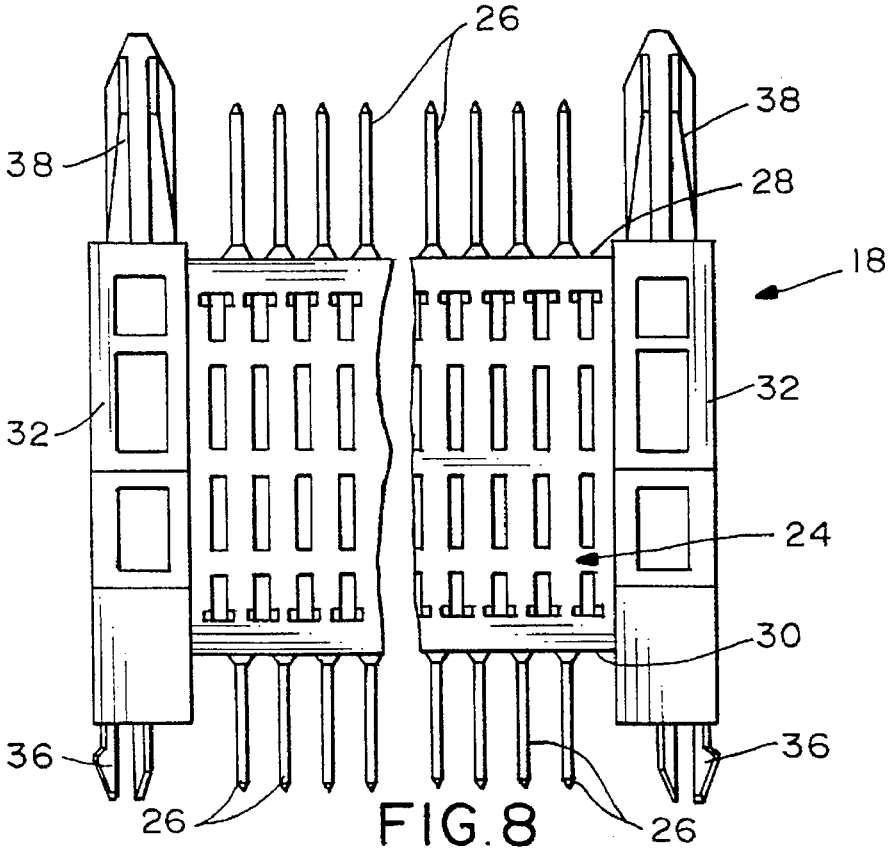
FIG. 8 is a fragmented side elevational view of the connector shown in FIG. 7.

More particularly, referring to FIGS. 7–9 in conjunction with FIGS. 1 and 2, first electrical connector 18 is adapted for mounting to one side 22 of printed circuit board 16. The first connector includes an elongated dielectric housing, generally designated 24, having terminal pins 26 extending entirely therethrough between a first board-engaging face 28 of the housing and a second board-mounting face 30. The housing is unitarily molded of plastic material or the like and includes opposite ends 32. Terminal pins 26 project beyond first board-engaging face 28 for insertion into holes 34 in circuit board 22. The terminal pins project beyond board-mounting face 30 for insertion into appropriate holes in a second printed circuit board (not shown). A pair of boardlocks 36 also project beyond second board-mounting face 30 for insertion into appropriate boardlock holes in the second printed circuit board. Therefore, the first electrical connector 18 is considered a "spacer" connector in that it is mounted between a pair of printed circuit boards, with terminal pins 26 establishing electrical connection between the boards.

Lastly, first electrical connector 18 includes a pair of generally rigid locating posts 38 projecting from the board-engaging face 28 and passing entirely through associated locating holes 40 in printed circuit board 16. One locating post 38 is disposed at each opposite end 32 of connector housing 24. As best seen in FIGS. 7–9, each locating post is generally cross-shaped in cross-section.

Figure 3:
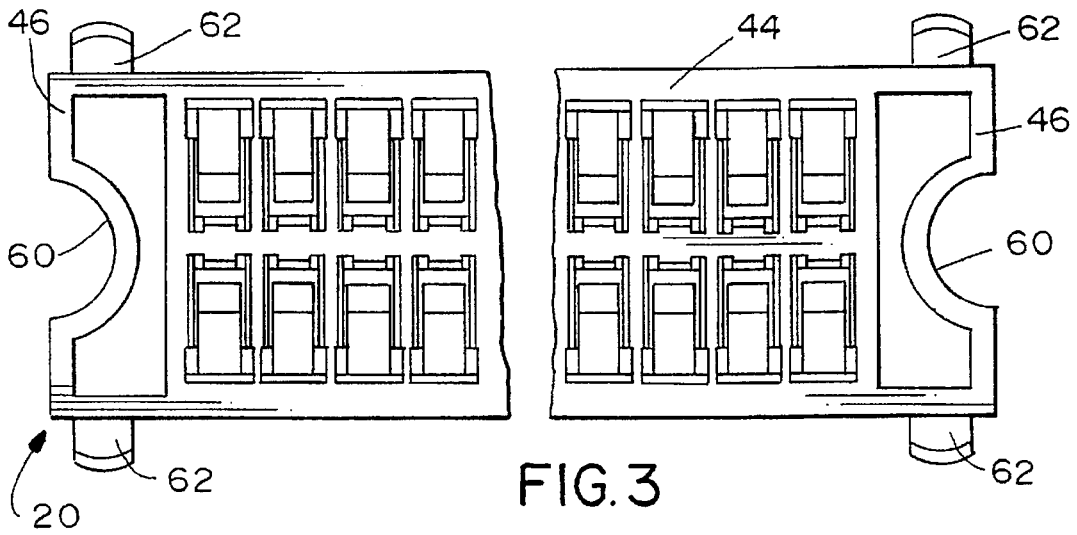
FIG. 3 is a fragmented top plan view of the top connector shown in FIG. 2.
Figure 4:
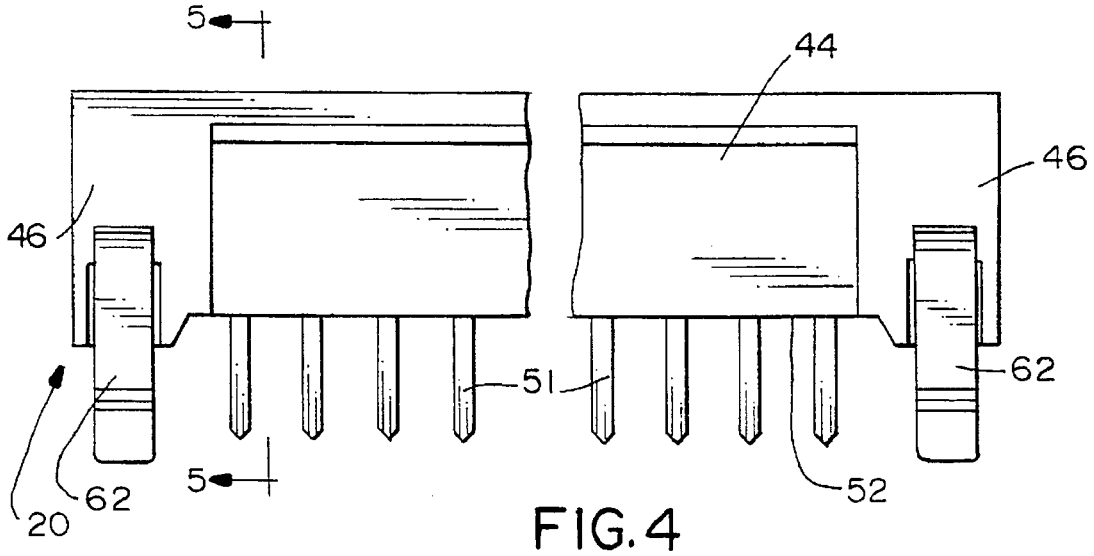
FIG. 4 is a fragmented side elevational view of the connector of FIG. 3.
Figure 5:
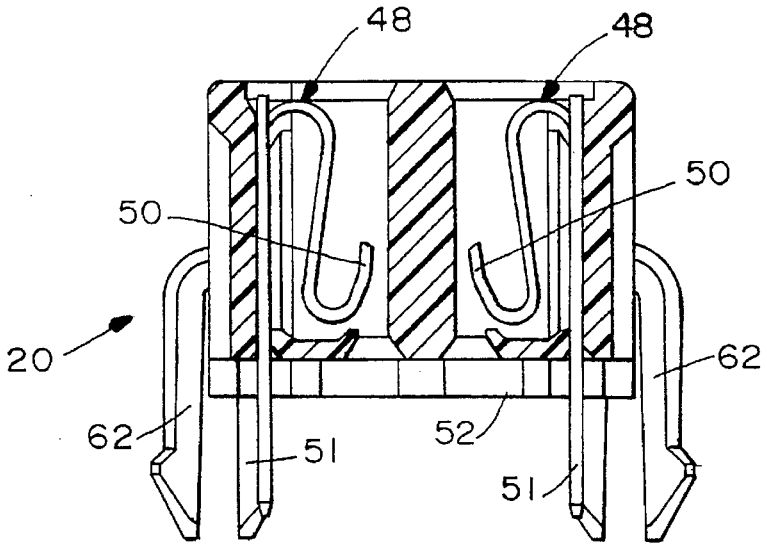
FIG. 5 is a vertical section taken generally along line 5—5 of FIG. 4.

Referring to FIGS. 3–5 in conjunction with FIGS. 1 and 2, the second electrical connector 20 is adapted for mounting to the opposite side 42 of printed circuit board 16. The second connector includes an elongated housing 44 having opposite ends 46. The housing is unitarily molded of plastic material or the like and mounts a plurality of terminals, generally designated 48 in FIGS. 2 and 5. It can be seen that terminals 48 have contact portions 50 for engaging terminal pins 26 projecting through circuit board 16 from first connector 18, as clearly seen in FIG. 2. The terminals have tail portions projecting from a board-mounting face 52 of second connector 20 through holes 54 in the circuit board outside the bounds of housing 24 of first connector 18, again as best seen in FIG. 2.

The invention contemplates that the second connector 20 include an outwardly opening semi-cylindrical locating channel 60 at each opposite end 46 of housing 14 as best seen in FIGS. 1 and 3. In essence, the channels open outwardly in opposite longitudinal directions at the opposite ends of the connector housing. The channels are sized and shaped and longitudinally spaced to establish a non-conductive interference fit with the generally rigid locating posts 38 extending from first connector 18 through holes 40 in printed circuit board 16. As the first and second connectors are mated, the locating posts 38 create a force toward the corresponding locating channel 60 creating a "pinching engagement".

In addition, second connector 20 includes a pair of bifurcated boardlocks 62 disposed generally on opposite lateral sides of each locating channel 60 as best seen in FIG. 3. The boardlocks are adapted for insertion into holes 64 (FIG. 1) in printed circuit board 16.

Figure 6:
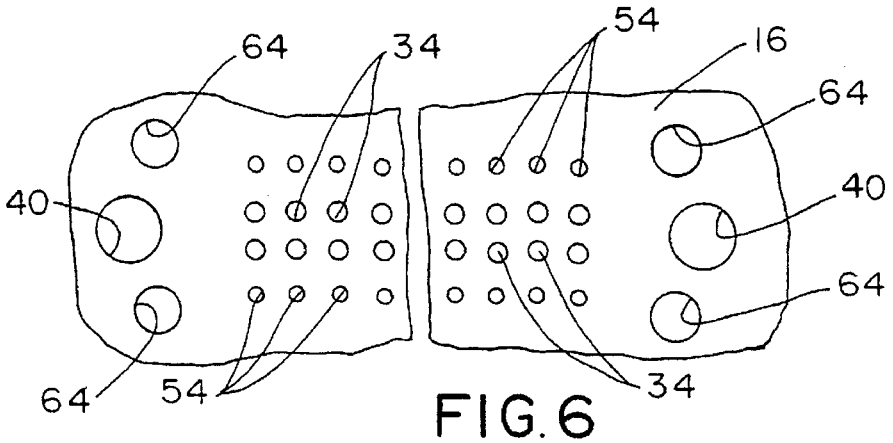
FIG. 6 is a fragmented plan view of the pattern of holes in the printed circuit board.

FIG. 6 shows the pattern of holes in printed circuit board 16 for receiving the terminals, locating posts and boardlocks of connector assembly 14. More particularly, two center rows of holes 34 extend in the center of the pattern or array of holes for receiving terminal pins 26 of first connector 18. The larger holes 40 for receiving locating posts 38 of the first connector can be seen located at opposite ends of the center rows of terminal-receiving holes 34. A row of terminal-receiving holes 54 run generally parallel to the rows of terminal-receiving holes 34 on opposite sides of the center rows for receiving tail portions 51 of terminals 48 projecting from second connector 20. Two pairs of the boardlock-receiving holes 64 can be seen clearly in FIG. 6 to be disposed on opposite lateral sides of locating holes 40. Therefore, the overall lengths of the pattern of holes is not increased because of the requirement of having boardlock-receiving holes 64.

FIGS. 10 and 11 show a prior art connector, generally designated 70, including an elongated dielectric housing 72 mounting a plurality of terminals which include tail portions 74 for insertion into appropriate holes 76 in a printed circuit board 78 (FIG. 12). Housing 72 of connector 70 includes a pair of cylindrical locating holes 80 at opposite ends of the array of terminals 74. These locating holes are adapted for receiving a pair of locating posts extending from another electrical connector (not shown) mounted on an opposite side of circuit board 78. In essence, the locating posts of the second connector extend through holes 82 in circuit board 78 and into cylindrical locating holes 80 in connector housing 72 creating an interference fit.

Prior art connector 70 in FIGS. 10 and 11 also include a pair of boardlocks 84 projecting from a board-mounting face 86 of connector housing 72 for insertion into boardlock holes 88 in printed circuit board 78. It can be seen that one of the boardlocks 84 is disposed longitudinally outside and in alignment with each locating hole 80. This is a typical arrangement for such prior art connectors, and it can be seen how this arrangement significantly increases the length of connector 70.

Correspondingly, FIG. 12 shows that with boardlock holes 88 being disposed in longitudinal alignment with and longitudinally outside locating holes 82, the overall length of the pattern of holes in the printed circuit board is greatly increased, resulting in a loss of valuable space or "real estate" on the printed circuit board. By comparing the prior art pattern of holes in circuit board 78 in FIG. 12 with the pattern of holes in circuit board 16 in FIG. 6, it is readily apparent how the connector assembly of the invention efficiently reduces the size of the respective connectors and saves valuable space on the printed circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector assembly for releasably connecting a first connector from one side of a printed circuit board to the printed circuit board, including a second electrical connector releasably mating to said first connector with terminal means extending through appropriate terminal receiving holes in the printed circuit board from a side of the board opposite said one side and electrically connecting to terminal means on the second connector and said first and second connectors sandwiching the board therebetween, comprising:

said first connector including an elongated dielectric housing having a generally rigid locating post disposed at each opposite end of the housing and adapted to pass through the printed circuit board; and said second connector adapted for mounting to the opposite side of the printed circuit board and including an elongated dielectric housing having an outwardly opening semi-cylindrical locating channel at each opposite end of the elongated housing of the second connector for receiving said locating posts and establishing a non-conductive interference fit therewith, and a pair of boardlocks disposed generally on opposite lateral sides of each of said locating channels and adapted for insertion into appropriate boardlock holes in the printed circuit board.

2. The electrical connector assembly of claim 1 wherein said second connector includes additional terminal means adapted for electrical connection to circuit means on the printed circuit board.

3. The electrical connector assembly of claim 2 wherein the housing of said second connector is wider than the housing of said first connector, and said additional terminal means of the second connector are arranged in at least one row lengthwise of the connectors outside said terminal means of the first connector.

4. The electrical connector assembly of claim 1 wherein said first connector comprises a spacer connector including a first face for mating to said second connector through said printed circuit board and a second mounting face for mounting to a second printed circuit board.

5. The electrical connector assembly of claim 1 wherein said locating post is cross-shaped in cross-section to present at least one edge for establishing the non-conductive interference fit with the semi-cylindrical locating channel.

6. An electrical connector assembly for releasably connecting a first connector from one side of a printed circuit board to the printed circuit board, including a second electrical connector releasably mating to said first connector with terminal means extending through appropriate terminal-receiving holes in the printed circuit board the circuit board from a side of the board opposite said one side and electrically connecting to terminal means on the second connector and said first and second connectors sandwiching the board therebetween, comprising:

said first connector including an elongated dielectric housing of a given width, the housing having a generally rigid locating post disposed at each opposite end thereof and adapted to pass through a locating hole in the printed circuit board;

said second connector adapted for mounting to the opposite side of the printed circuit board and including an elongated dielectric housing having a given width wider than the width of the housing of the first connector, the housing of the second connector having a longitudinally outwardly opening semi-cylindrical locating channel at each opposite end thereof for receiving a respective one of the locating posts of the first connector and establishing a non-conductive interference fit therewith, and a pair of boardlocks disposed generally on opposite lateral sides of each locating channel and adapted for insertion into appropriate boardlock holes in the printed circuit board; and terminal means mounted on the housing of the second connector and including contact portions for electrically engaging the terminal means projecting from the first connector and tail portions for extending into appropriate terminal-receiving holes in the printed circuit board laterally outside the terminal means of the first connector.

7. The electrical connector assembly of claim 6 wherein at least one of said connectors comprises a spacer connector including a first face for mating to said second connector through said printed circuit board and a second mounting face for mounting to a second printed circuit board.

8. The electrical connector assembly of claim 6 wherein each said locating post is cross-shaped in cross-section to present at least one edge for establishing the non-conductive interference fit with the semi-cylindrical locating channel.

* * * * *